US005321383A

United States Patent [19]

Colange et al.

[11] Patent Number: 5,321,383

[45] Date of Patent: Jun. 14, 1994

[54] CONTROL SYSTEM FOR A VARIABLE INPUT DEVICE HAVING A SLIDER

[75] Inventors: Jacques Colange, Fontenay-sous-Bois; Jean Colange, Le Perreu-sur-Marne, both of France

[73] Assignee: Moviluty, Le Perreux-sur-Marne, France

[21] Appl. No.: 25,747

[22] Filed: Mar. 3, 1993

[30] Foreign Application Priority Data

Mar. 6, 1992 [FR] France ..... 92 02730

[51] Int. Cl.[5] ..... H01C 10/00

[52] U.S. Cl. ..... 338/153; 338/184; 318/551; 112/217.4

[58] Field of Search ..... 338/153, 118, 160, 176, 338/184; 318/543, 551; 388/840; 112/217.4, 277

[56] References Cited

U.S. PATENT DOCUMENTS 3,639,877 2/1972 Fresard et al. ..... 338/153
4,046,049 9/1977 Luce et al. ..... 338/153 X
4,139,831 2/1979 Ortlieb et al. ..... 338/153 X
4,284,018 8/1981 Szostak ..... 112/217.4
4,299,182 11/1981 Tanaka ..... 112/277

*Primary Examiner*—Marvin M. Lateef
*Attorney, Agent, or Firm*—Sughrue, Mion, Zinn, Macpeak & Seas

[57] ABSTRACT

A control system for a variable input device 2 having a slider 14 has a box 1 housing a trigger 3 capable of moving in translation between two positions relative to the box. One of the two positions constitutes a rest position. Springs 13 apply a resilient force to the trigger to urge it towards the rest position. A coupling element 45 couples the trigger with the slider 14. A foot lever 9 is mounted for rotation relative to the box about a first horizontal axis 17. The rotary motion of the lever is translated into translation motion of the trigger by a sliding block 31 mounted within the box so as to move in translation relative to the box. One end 37 of the sliding block comes into contact with the trigger. A translation control device 10 controls the extent of translation motion of the sliding block 31.

9 Claims, 4 Drawing Sheets

CONTROL SYSTEM FOR A VARIABLE INPUT DEVICE HAVING A SLIDER

The present invention relates to a control system for a variable input device having slider, and more particularly to control system used for varying the operating speed of certain portable electrical tools.

BACKGROUND OF THE INVENTION

In the example of flexible transmission machines, such a control system is used for controlling the operating speed of tools disposed at the end of the flexible transmission. Since the user's hands are often occupied elsewhere, such control systems organized to have a pedal for control by the foot. However, such foot control does not provide great accuracy and the tooling often includes additional hand-adjusted control means for setting the operating speed of tools more accurately. The need to provide two distinct control means enabling the operating speed of tools to be varied is disadvantageous both with respect to the ease with which the tools can be used and with respect to the cost thereof.

To overcome this drawback, American patent U.S. Pat. No. A-4 299 182 proposes a control system including a pedal acting on a rheostat, and a series of buttons enabling circuits comprising discrete resistances to be selected to replace the rheostat. However, such buttons are not capable of enabling continuous adjustment of the controlled parameter to be obtained by hand. In addition the circuit included in that control system is relatively complex since it is necessary to provide a large number of discrete resistances and of switching means in addition to the rheostat conventionally included in pedal control means.

U.S. Pat. A-4 284 018 discloses a sewing machine control system in which a conventional pedal means can be slid inside a box that includes hand control means enabling the pedal to be adjustably pressed down. Although that control system does indeed enable continuous and accurate manual control to be obtained, it is not optimum with respect to cost and ease of use since it requires a box in addition to and distinct from the pedal control means.

OBJECT AND SUMMARY OF THE INVENTION

An object of the present invention is thus to provide a control system for a variable input device having a slider, that enables foot control input functions and hand control input functions to be effected in complete safety, which is simple and compact in structure, and which is easy to use.

More precisely, the present invention provides a control system for a variable input device having a slider, and comprising:

a box;

a trigger, said trigger being capable of moving between two positions relative to said box, one of said two positions constituting a rest position;

means for applying a resilient force on said trigger tending to return it towards said rest position;

means for coupling said trigger to said slider;

a lever;

means for mounting said lever for rotation relative to said box about a first axis;

means for transforming the rotary motion of said lever into translation motion applied to said trigger;

a sliding block;

means for mounting said sliding block to move in translation relative to said box, with one end of said sliding block being adapted to come into contact with said trigger; and means for controlling the translation of said sliding block.

BRIEF DESCRIPTION OF THE DRAWINGS

Other characteristics and advantages of the present invention appear from the following non-limiting description given with reference to the accompanying drawings, in which.

MORE DETAILED DESCRIPTION

In order to simplify the description, the same references are used throughout the FIGURES to designate the same items, regardless of the figures in which they appear and regardless of the way in which the items are shown in the FIGURES.

The control system shown in FIGS. 1 to 7 is used for continuously controlling the value of a parameter. By way of non-limiting example, the parameter may be the speed of rotation of a tool coupled to a motor by means of a flexible transmission, in which case the control system is connected to the motor.

Figure 1:
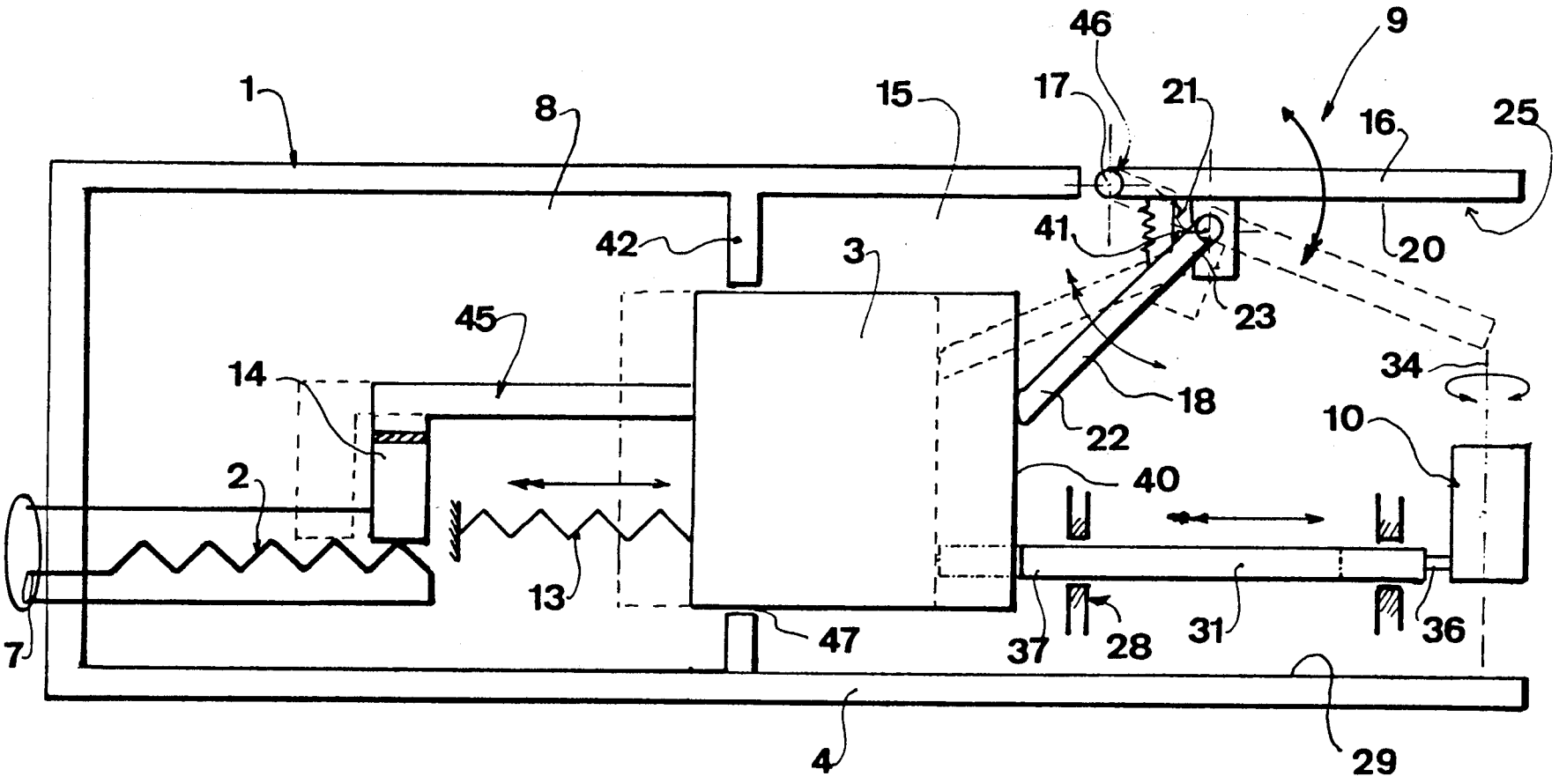
FIG. 1 is a schematic diagrammatic view of the invention for controlling a variable input device having a slider.
Figure 2:
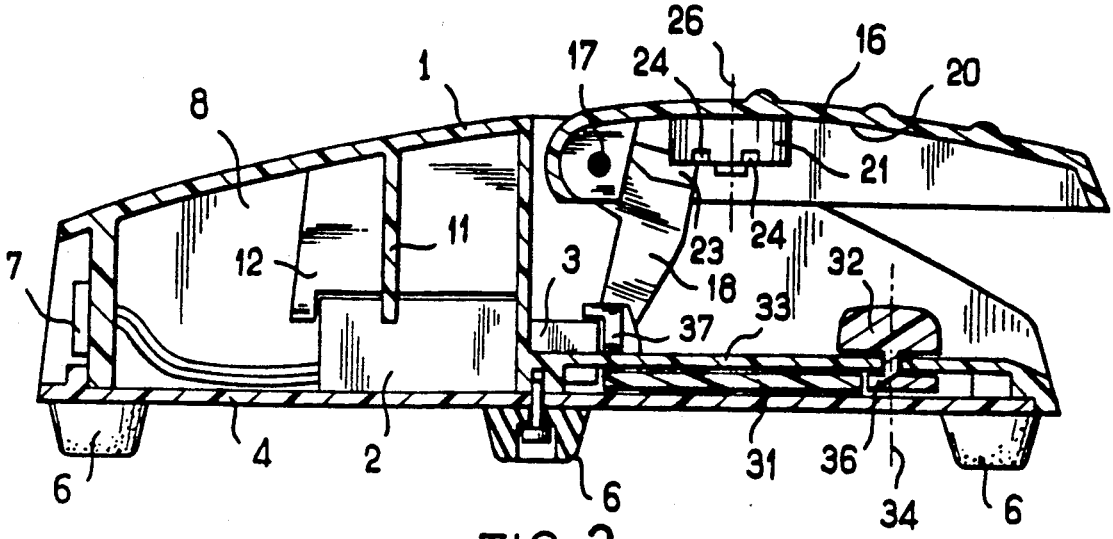
FIGS. 2 and 3 are section views in elevation through a first embodiment of the means of the invention, on sections being taken on the plane referenced I—I in FIG. 6.

FIG. 1 is a diagram showing the control system for controlling a variable input device 2 having a slider 14. The control system includes a box 1 and a trigger 3 capable of moving in translation in continuous manner, e.g. on guide rails or the like, between two positions relative to the box, with one of the two positions corresponding to a rest position, e.g. the position shown in FIG. 1.

The control system also includes means for applying a resilient force on the trigger tending to return it towards its rest position, means 45 for coupling the trigger 3 with the slider 14, a lever 9, means 46 for mounting said lever 9 to rotate relative to the box about a first axis 17, and means for transforming the rotary motion of the lever into translation motion of the trigger 3.

It also includes a sliding block 31, means for mounting the sliding block 31 to slide in translation relative to the box, one end 37 of the sliding block being suitable for coming into contact with a face 40 of the trigger 3, and means 10 for controlling translation motion of the sliding block 31.

In an advantageous embodiment, the box 1 includes at least first and second separate housings 8, 15 that are separated by a dividing wall 42 or the equivalent, the variable input device being disposed in the first housing 8 and the trigger projecting by means of its face 40 into the second housing 15, by passing through a slot or the like 47 formed through said dividing wall.

The second housing 15 includes at least one opening 25 with the axis of rotation 17 of the lever 9 being situated substantially in the same plane as said opening so that the lever or at least a portion of the lever constitutes a wall for closing said opening 25. The means 28 for supporting the sliding block to move in translation relative to the box are situated substantially on that wall 29 of the second housing which is situated substantially opposite to the opening 25.

The control system also includes means for retracting the lever 9 from the opening 25 so as to give access to the inside of the second housing 15. The means for retracting the lever 9 may be implemented in numerous different ways, and FIGS. 2 to 7 show a preferred embodiment.

In an advantageous embodiment, the lever 9 is constituted by a pedal portion 16, an actuator element 18, and means for supporting the actuator element to rotate relative to the pedal portion 16 about a second axis 41, FIG. 1, parallel to the first axis 17. The means for transforming the rotary motion of the lever 9 into translation motion of the trigger 3 are then constituted by the free end 22 of the actuator element 18 mounted for sliding co-operation advantageously with the face 40 of the trigger 3, e.g. a face that extends perpendicularly to the translation direction of the trigger and suitable for moving in the second housing 15.

The control means advantageously also includes means for defining the angular position of the actuator element 18 relative to the pedal portion 16, and resilient return means 27 engaged between the actuator element 18 and the pedal portion 16.

The means 10 for controlling translation of the sliding block comprise manual drive means for imparting rotary motion about a third axis 34 and means for transforming said rotary motion into translation motion of the sliding block 31. The means for transforming the rotary motion into translation motion of the sliding block 31 include at least one cam 36 mounted to rotate about the axis 34 which is substantially perpendicular to the displacement direction of the sliding block and to the above-defined first axis 17, and also one end of the sliding block which is designed to be suitable for sliding over the edge surface 43 of the cam 36 in such a manner as to ensure that the distance between each point of said edge and the third axis of rotation 34 varies from one point to another in compliance with a continuously increasing function.

FIGS. 2 to 7 show a preferred embodiment of a control means of the invention as shown diagrammatically in FIG. 1.

Figure 6:
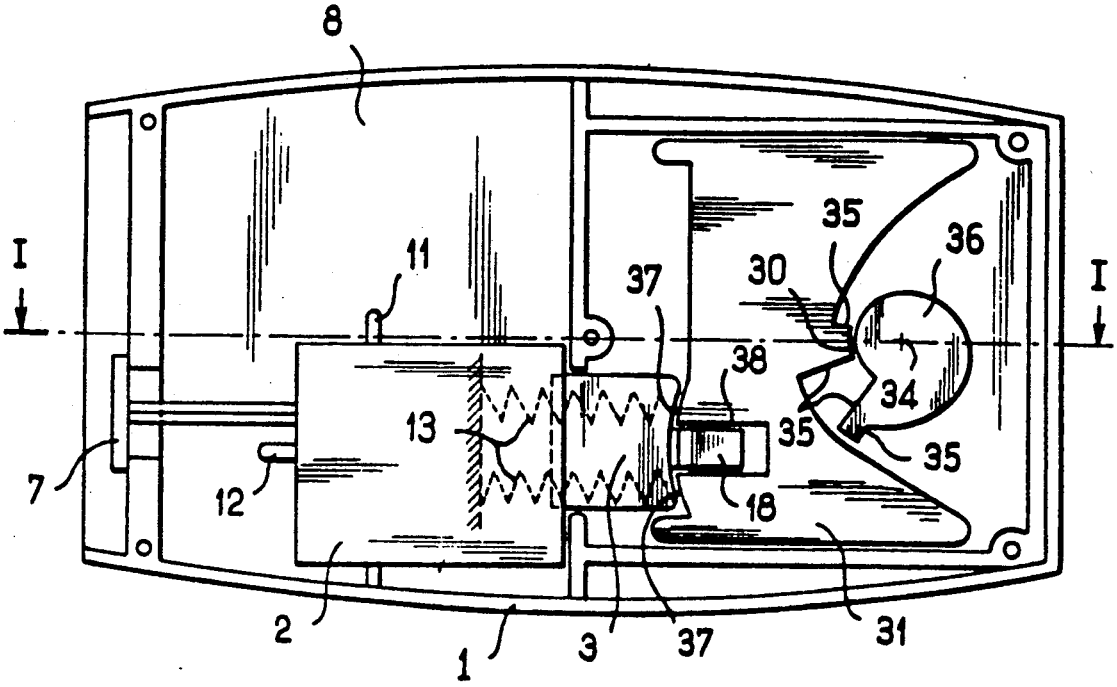
FIG. 6 and 7 are views of the underside of the control system of FIG. 2 and 3, with the bottom removed therefrom.
Figure 7:
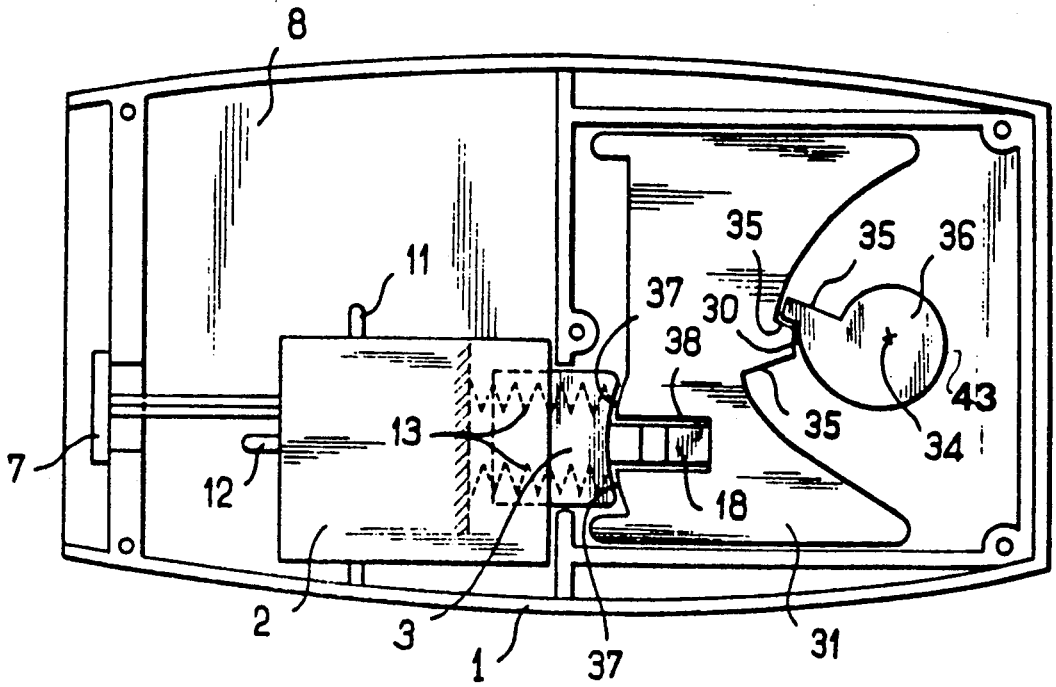

The control means implemented as shown in FIGS. 2 to 7 comprise a box 1 having the variable input device 2 mounted therein together with the trigger 3, the bottom portion of the box 1 being closed by a bottom plate 4 which is not shown in FIGS. 6 and 7 so as to reveal the inside of the box 1. Feet 6 of shock absorbing material are fixed beneath the plate 4.

The variable input device 2 may be constituted, for example, by a rheostat whose resistance varies depending on the position of the slider 14, and thus of the trigger 3, thereby defining a controlled speed value. However, the variable input device could be electronic, including a hybrid circuit with a triac under the control of the trigger 3.

To connect the control system to a flexible transmission machine, an output connector 7 is provided in electrical connection with the variable input device 2.

The variable input device 2 is secured by appropriate ribs 11 and 12. The trigger 3 is urged out from the first housing 8 by return springs 13 represented by dashed lines in FIGS. 6 and 7.

In one possible embodiment, the above-defined pedal portion 16 of the lever 9 constitutes foot-control means. The pedal portion 16 is hinged to the box 1 about a first axis 17 which advantageously extends perpendicularly to the displacement direction of the trigger 3. The axis 17 is embodied by a shaft received in two openings 19 formed in the box 1 (FIG. 4) and the actuator element 18 is pivotally mounted about said axis 17, in which case the first and second axes coincide. A spacer 21 is placed between the bottom face 20 of the pedal portion 16 and the actuator element 18, and it constitutes means for defining the angular position of the actuator element 18 relative to the pedal portion 16. When the pedal portion 16 is pressed down into the position shown in FIG. 2, the actuator element 18 has one end 22 pressed in a sliding position on the face 40 of the trigger 3, while its opposite end 23 is pressed against the spacer 21. When the pedal portion 16 is pressed down, the actuator element 18 acts as a lever to actuate the trigger 3 against return springs 13, thereby changing the position of the slider 14 and thus, in the selected embodiment of the control means, varying the speed of a motor that is actuating a tool.

In the embodiment of FIGS. 2 to 7, the manual drive means for imparting rotary motion about the third axis 34 are constituted by a knob 32 that is accessible on the surface 33 of the box 1 that extends substantially over the sliding block 31 and under the pedal portion 16. The knob 32 is rotatable about the axis 34 which is perpendicular to the surface 33, and the cam 36 is secured to said knob but is mounted beneath the surface 33 so that its cam surface edge bears against the end of the sliding block 31 opposite from its end that is in contact with the trigger.

As can be seen in FIGS. 6 and 7, the cam 36 is made in such a manner that the distance between each point on its camming surface edge and the third axis of rotation 34 varies, from one point to another, in compliance with a continuous increasing (or decreasing) function.

Furthermore, in order to ensure that the sliding block 31 acts effectively on the trigger 3, the contact surface 30 between the cam 36 and its follower 31 is always substantially perpendicular to the displacement direction of the sliding block 31 and of the trigger 3. When the user rotates the knob 32 so as to rotate the cam 36 from its position, FIG. 6, in which the follower is in contact with the point on the cam that is closest to the axis 34 all the way to the extreme position shown in FIG. 7 in which said end of the block is in contact with the point of the edge of the cam that is furthest from the axis 34, rotation of the cam 36 causes the sliding block 31 to move in translation, thereby driving the trigger against the return springs 13. When the user turns the knob 32 in the opposite direction, the return springs 13 push the trigger 3 and the sliding block 31 back in progressive manner. The cam 36 and the sliding block 31 include abutments 35 for limiting rotation of the cam 36.

Figure 3:
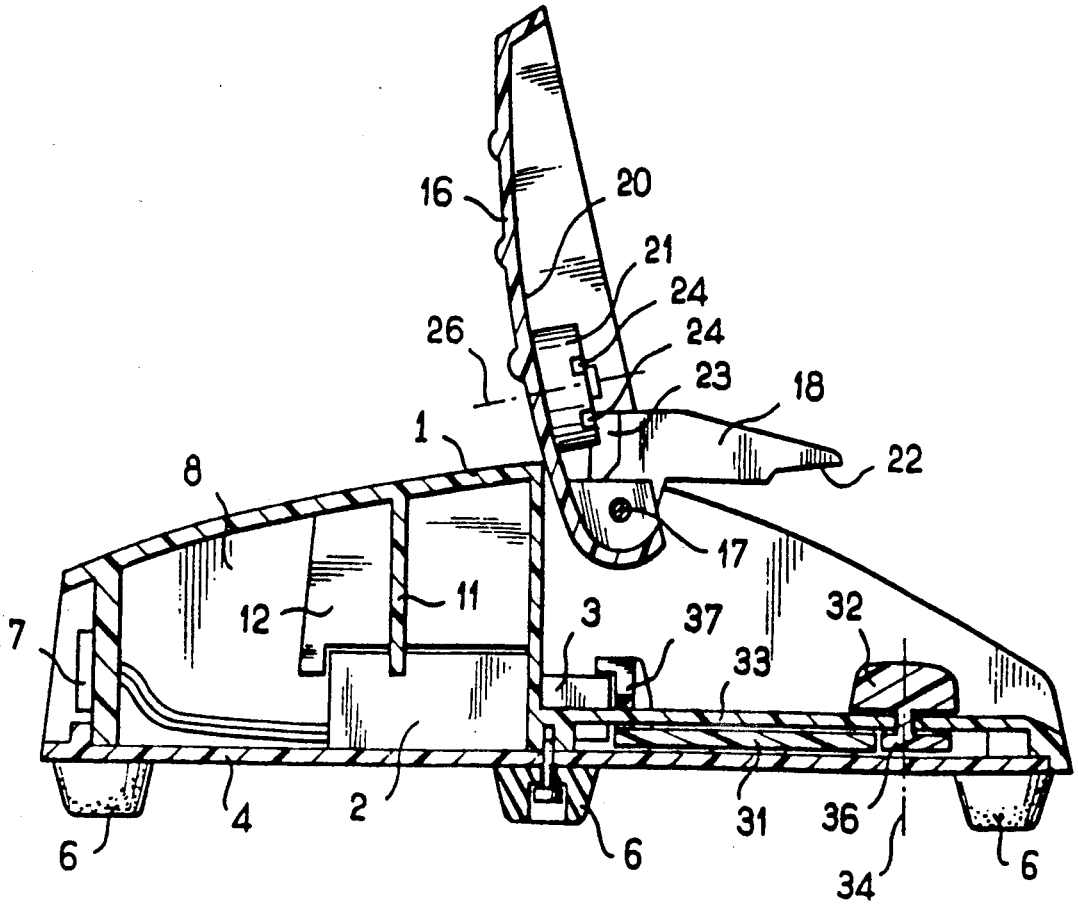
Figure 4:
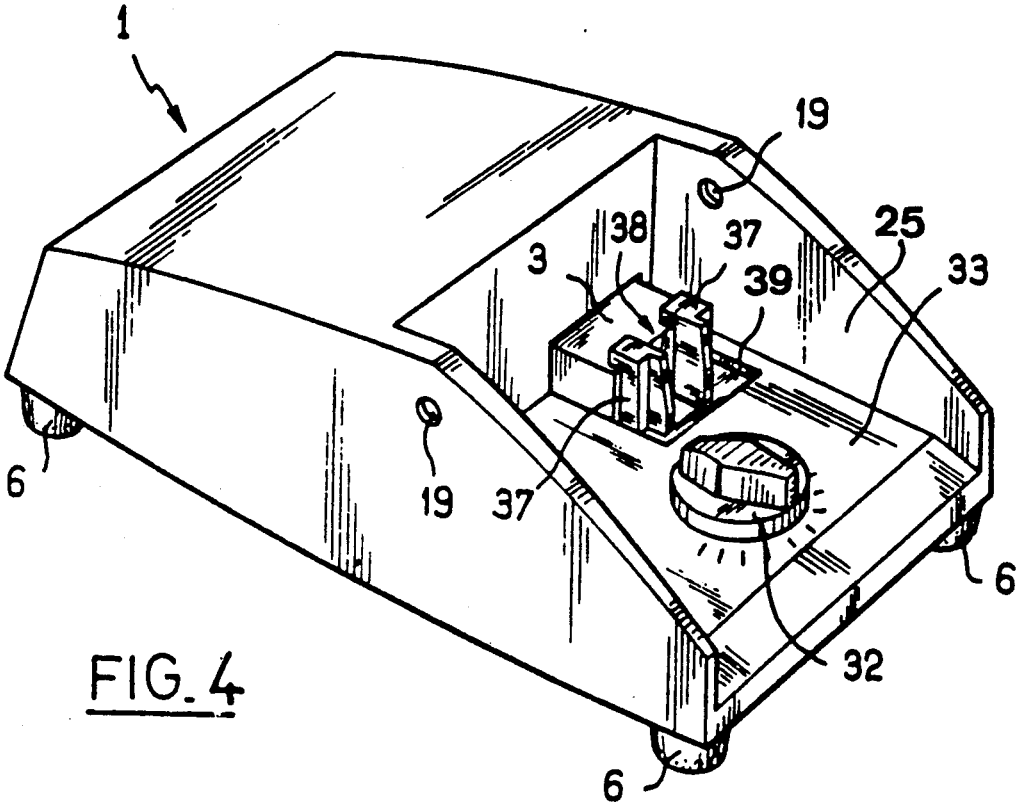
FIG. 4 is a perspective view of a portion of the invention shown in FIGS. 2 and 3.
Figure 5:
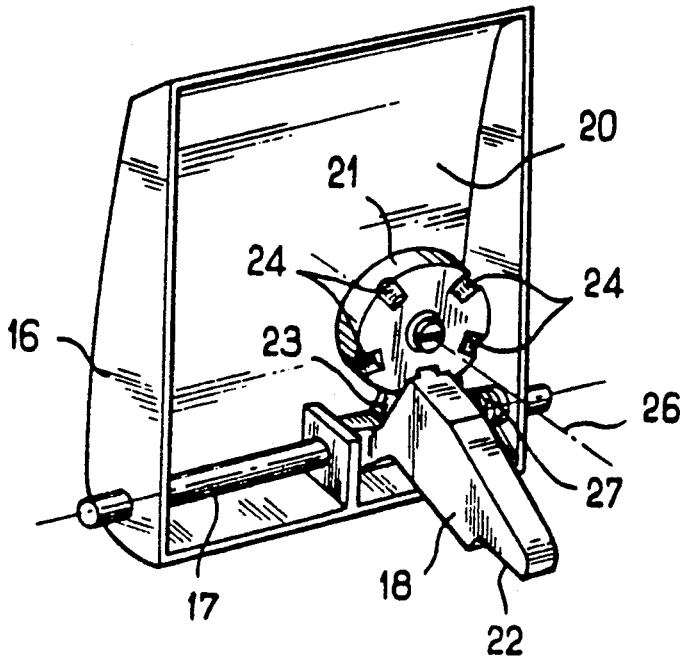
FIG. 5 is a perspective view of the foot control system for the embodiment of the invention shown in FIGS. 2 and 3.

In FIGS. 2, 3, 4, 6, and 7, it can be seen that the sliding block 31 has its end 37 urged against the trigger 3, which end advantageously includes two thrust elements that project above the surface 33 through a window 39, FIG. 4 provided therein. The two thrust elements 37 are spaced apart by a gap 38 which is slightly greater in width than the actuator element 18, and which is situated level with said actuator element 18, beneath the axis 17. The gap 38 leaves an exposed zone of the trigger 3 suitable for receiving the free end 22 of the actuator element 18.

In the embodiment shown, the pedal portion 16 is hinged on the box 1 in such a manner as to enable the pedal portion to be raised, rear vertical into a raised position as shown in FIG. 3. In this position, the surface 33 and the knob 32 are made accessible. The control system of the invention can thus be used either in "foot control means" with the pedal 16 folded down into the position shown in FIG. 2, or else in "hand control" mode with the pedal portion raised into the position shown in FIG. 3. Each of these two modes of using the control means make it possible to control the speed of rotation of a tool accurately in compliance with a continuous curve of values.

To limit the stroke of the trigger 3 in adjustable manner while the pedal portion 6 is in use, the thickness of the spacer 21 is adjustable. The spacer 21 is generally cylindrical in shape, having one face pressed against the bottom face 20 of the pedal portion 16 and having an opposite face that receives the end 22 of the actuator element 18. Close to its periphery, this face of the spacer 21 includes a plurality of radial notches 24 of different depths, and of width corresponding to the width of the end 23 of the actuator element 18. The spacer 21 is mounted to pivot on the bottom face 20 of the pedal portion 16 about an axis 26 which is perpendicular to said face 20 and which is offset relative to the position of the actuator element 18 so that the end 23 thereof engages in one of the notches 24 of the spacer 21.

In the embodiment of FIGS. 2 to 7, the resilient return means 27 engaged between the actuator element 18 and the pedal portion 16 are constituted by a coil spring disposed around the axis 17 and urging the actuator element 18 to rotate towards the spacer 21 so as to keep the end 23 of the element 18 in the selected notch of the spacer 21 regardless of the position of the pedal portion 16. Thus, the force of the coil spring 27 on the actuator element 18 must be greater than the force applied to said element by the return springs 13 when the trigger returns towards its return position. To adjust the angular position of the element 18 relative to the pedal portion 16, it sufficies to modify the setting of the spacer 21 as follows. The user raises the pedal to its raised position as shown in FIG. 3, moves the element 18 manually away from the spacer 21 against the force of the spring 27, rotates the spacer 21 about its axis 26 so as to bring the selected notch 24 to face the end 23 of the element 18, and releases the element 18 which is then returned towards the pedal portion 16 by the spring 27. The depth of the selected notch 24 defines the maximum value of the stroke of the trigger 3, and thus the maximum value of the variation available for the speed of rotation of the tool.

We claim:

1. Control system for a variable input device having a slider, said system comprising:

a box;

a trigger, means for mounting said trigger in said box for movement between two positions relative to said box, one of said two positions constituting a rest position;

means for applying a resilient force on said trigger tending to return said trigger towards said rest position;

means for coupling said trigger to said slider;

a lever;

means for mounting said lever on said box for rotation relative to said box about a first axis;

means for transforming the rotary motion of said lever into translation motion applied to said trigger;

said rotary motion transforming means comprising;

a sliding block;

means for mounting said sliding block for movement in translation relative to said box with one end of said sliding block movable into contact with said trigger; and means for controlling the translation of said sliding block.

2. The system according to claim 1, wherein said box includes at least a first housing and a second housing separated by a dividing wall, said variable input device being disposed in the first housing and said trigger extending into the second housing, said second housing including at least one opening, the axis of rotation of said lever being situated substantially in the plane of said opening, and the means for mounting said sliding block for movement in translation relative to said box being situated substantially on a wall of said second housing substantially opposite to said opening.

3. The system according to claim 2, wherein said lever constitutes a wall for closing off said opening of said second housing.

4. The system according to claim 3, further including means for retracting said lever to provide access to the inside of said second housing.

5. The system according to claim 1, wherein said lever is constituted by a pedal portion, an actuator element, and means for mounting said actuator element to rotate relative to said pedal portion about a second axis substantially parallel to said first axis, said means for transforming the rotary motion of said lever into translation motion of said trigger is constituted by a free end of the actuator element mounted for sliding engagement with a face of said trigger.

6. The system according to claim 5, further including means for defining the angular position of said actuator element relative to said pedal portion and resilient return means pressed against said actuator element and said pedal portion for biasing said actuator element.

7. The system according to claim 1, wherein the means for controlling translation of said sliding block include manual drive means for imparting rotary motion about a third axis substantially perpendicular to said first axis and to the displacement of said sliding block, and means for transforming said rotary motion into translation motion of said sliding block.

8. The system according to claim 7, wherein the manual drive means for imparting rotary motion about said third axis include a rotary motion about said third axis include a rotary knob, and by the fact that the means for transforming the rotary motion into translation motion of the sliding block include a cam secured to said knob, said cam being made in such a manner that the distance between each point of its edge surface and its axis of rotation varies from one point to another, in compliance with a continuously increasing function, the end of the sliding block opposite to its end which is in contact with the trigger being in sliding co-operation with the edge face of said cam.

9. The system according to claim 1, wherein said first and second axes coincide.

* * * * *